US005439499A

United States Patent [19]

Pastor et al.

[11] Patent Number: 5,439,499

[45] Date of Patent: Aug. 8, 1995

[54] CERMETS BASED ON TRANSITION METAL BORIDES, THEIR PRODUCTION AND USE

[75] Inventors: Henri Pastor; Colette Allibert, both of Grenoble; Laurent Ottavi, Voiron, all of France; Manuel Albajar, Caldes de Montbui; Francisco Castro-Fernandez, San Sebastian, both of Spain

[73] Assignee: Sandvik AB, Sweden

[21] Appl. No.: 979,868

[22] PCT Filed: Jun. 26, 1992

[86] PCT No.: PCT/FR92/00595

§ 371 Date: Feb. 26, 1993

§ 102(e) Date: Feb. 26, 1993

[87] PCT Pub. No.: WO93/00452

PCT Pub. Date: Jan. 7, 1993

[30] Foreign Application Priority Data

Jun. 28, 1991 [FR] France ..... 91 08030

[51] Int. Cl.[6] ..... C22C 29/12; B22F 3/12; B24D 17/00

[52] U.S. Cl. ..... 75/232; 75/233; 75/235; 75/244; 75/246; 419/12; 419/13; 419/19; 419/20; 419/26; 419/32; 419/33; 419/39; 419/49; 419/56; 419/58; 51/307; 51/309

[58] Field of Search ..... 75/232, 233, 234, 235, 75/244, 246; 419/12, 13, 19, 20, 32, 33, 38, 39, 49, 26, 56, 58; 501/96; 51/307, 309

[56] References Cited

U.S. PATENT DOCUMENTS

| | | | |
|---|---|---|---|
| 4,022,584 | 5/1977 | Rudy | 228/122.1 |
| 4,246,027 | 1/1981 | Watanabe et al. | 75/244 |
| 4,610,726 | 9/1986 | King | 75/233 |
| 4,671,822 | 6/1987 | Hamashima et al. | 75/244 |
| 4,689,077 | 8/1987 | Chevigne et al. | 75/233 |
| 4,770,701 | 9/1988 | Henderson et al. | 75/232 |
| 4,873,053 | 10/1989 | Matsushita et al. | 419/11 |
| 4,880,600 | 11/1989 | Moskowitz et al. | 419/12 |
| 5,045,512 | 9/1991 | Lange et al. | 501/96 |
| 5,089,047 | 2/1992 | Buljan et al. | 75/236 |

FOREIGN PATENT DOCUMENTS

| | | |
|---|---|---|
| 0232223A3 | 8/1987 | European Pat. Off. . |
| 0349740A3 | 1/1990 | European Pat. Off. . |
| 0433856A1 | 6/1991 | European Pat. Off. . |
| 2476139 | 8/1981 | France . |
| 2514788 | 4/1983 | France . |
| 2846889 | 4/1980 | Germany . |
| 53-140209 | 12/1978 | Japan . |

*Primary Examiner*—Ngoclan T. Mai

*Attorney, Agent, or Firm*—Burns, Doane, Swecker & Mathis

[57] ABSTRACT

A cermet useful in the fabrication of metal cutting, rockdrilling and mineral tools, as well as wear parts. The cermet comprises (i) a hard phase of a simple boride of a transition metal, a mixture of simple borides of transition metals, or a mixed boride of transition metals; (ii) a binder phase of Fe, Ni, Co, Cr, or alloys thereof; (iii) a dispersion of particles of oxides of transition metals in which the oxygen can be replaced by nitrogen and/or carbon; and (iv) a dispersion of oxides of metals chosen from aluminum and Group IIA and IIIA metals.

17 Claims, No Drawings

CERMETS BASED ON TRANSITION METAL BORIDES, THEIR PRODUCTION AND USE

BACKGROUND OF THE INVENTION

The invention relates to cermets based on transition metal borides, especially titanium diboride, which have an improved toughness.

Cermets are hard materials particularly useful for making metal cutting and rock drilling tools, as well as wear parts. As their name indicates they in general, contain a hard but brittle ceramic phase as a major constituent, and a metallic binder phase less hard but tough, which gives them an interesting and rare combination of hardness and toughness. The notation ceramic is taken in a broad sense, including in particular the oxides, nitrides, carbides and borides of the transition metals, as well as their combinations.

It is known that certain metals such as iron, nickel, cobalt, chromium, copper, etc., and their alloys, have been used as binders in the fabrication of cermets based on transition metal borides, most commonly diborides of these metals, and particularly titanium diboride $TiB_2$. These metals or alloys have, in principle, two functions. First, they ensure the formation of a liquid phase, often with a certain quantity of the boride dissolved in this liquid phase, thus wetting as well as possible the solid component, which, in principle, facilitates the sintering and permits a complete densification. Furthermore, they contribute a certain toughness to the sintered cermet which thus includes a hard but brittle phase (the boride) and a metallic binder, less hard, but ductile (the binder metal or alloy).

In reality, however, the study of the literature shows that experimentally the densification by liquid phase sintering of such cermets is not perfect and often insufficient. The open porosity remains significant (4 to 30 volume %), and the metallic binder is often transformed, at least partially, to boride through a chemical reaction with the hard phase. This results in a considerable decrease in the toughness of the cermet, which restricts possible fields of application.

The inventors have confirmed these findings experimentally, particularly for the cermets $TiB_2$—Fe. In order to make such cermets, powder of titanium boride $TiB_2$ (average grain diameter: 1 to some/μm) was mixed with iron powder (average grain diameter: 1 to some μm) using conventional means such as mixer, ball mill, attritor mill, etc. The mixture was subsequently compacted under a pressure of 100 to 200 MPa. The compacted product was sintered for 1 to 4 hours, at a temperature of between 1450° and 1550° C., depending on the amount of iron in the cermet (10 to 20 volume %). It was found that the densification was very poor (the remaining porosity varying between 10 and 20%) and that the major part of the binder iron metal had been transformed to the brittle $Fe_2B$ and/or FeB boride, thus causing a decrease in toughness. This makes the use of such a material practically impossible for the envisaged applications.

In it appeared practically unrealistic to obtain a boride metal (or alloy) cermet due to the interaction, during sintering, of the metallic binder and the hard boride, with the at least partial boruration of the metallic binder.

Accordingly, an object of the present invention is to find the conditions which permit the fabrication of cermets based on transition metal borides without presenting the disadvantages of cermets of this type made according to prior art, and thus permitting their use in the envisaged applications because of their high toughness.

SUMMARY OF THE INVENTION

After extensive research, the inventors found that the interaction between the hard transition metal boride and the metallic binder, which imparts a decrease in toughness, can been avoided, or at least significantly reduced, by adding to the binder certain metal elements, in the form of simple or compounded bodies, during preparation of the mixture of the boride and the metallic binder, before the sintering of the mixture.

The elements are essentially the transition metal being the major metallic element of the boride constituting the hard phase, and a metal X chosen among aluminium and the metals of groups IIA and IIIB of the Periodic Table, or a mixture of at least two of these metals X.

During sintering, the added transition metal is transformed into oxide in which part of the oxygen can be replaced by nitrogen and/or carbon and the metal X is transformed to oxide. These oxides are precipitated as dispersions of separated oxide particles, or in the form of complex oxides.

The carbon possibly present in the transition metal oxide is due to the presence of this element, as an impurity, in the hard phase boride.

Thus, the invention provides a cermet comprising: (i) a hard phase of a simple boride TxBy, a mixture of simple borides TxBy +T'x'By' or a mixed boride (T,T')xBy wherein T and T' are principally transition metals of groups IVB to VIB of the period table and x, x', y and y' are whole or decimal numbers, preferably whole numbers, which can be identical or different; and (ii) a binder phase of a pure binder metal L, or an alloy of at least two metals (L,L'. . . ) wherein L is a metal chosen from the group of Fe, Ni, Co, Cr and L' is at least one metallic element which, when alloyed with L, does not substantially decrease toughness. The cermet additionally contains (iii) a dispersion of particles of the oxide of the transition metal T or T' being the major metallic element in the hard phase (i); an oxide in which a part of the oxygen can be replaced by nitrogen and/or carbon, (iv) a dispersion of particles of oxide of a metal X chosen among aluminum and the metals of groups IIA and IIIB of the period table, it being understood that the oxide forming the dispersions (iii) and (iv) can be combined in the form of complex oxides.

As used herein, the transition metals of groups IVB to VIB (or 4 to 6) of the periodic table are: Ti, Zr, Hf, V, Nb, Ta, Cr, Mo, W.

Advantageously, the ratios x/y and x'/y', which can be identical or different, are equal to ½ or 2/5, or close to these values.

The metals X of group IIA, or alkaline earths, preferably used according to the invention, are Mg and Ca.

The metals X of group IIIB, which contain Se, Y, the lanthanides and the actinides, preferably used according to the invention, are Ce, Pr, Nd, Cad, Dy, Th, and U, as well as alloys of iron and the lanthanide metals, such as that known under the name of Mischmetall.[R]

According to the preferred fabrication mode, the cermet according to the invention contains between 20 and 99%, preferably between 50 and 97 weight % of the hard phase (i).

According to another aspect, the invention provides a fabrication process of the cermet as defined above. The process comprises: (a) mixing with milling: a powder of a hard phase of a simple boride TxBy or a mixture of simple borides TxBy+T'x'By' or a mixed boride (T,T')xBy, T,T;,x,x'y and y' being as defined as above, a powder of a pure binder metal L, or a pre-alloy in which L is the major component, optionally at least one powder of an alloying metal element L' which, when alloyed with L, does not substantially decrease toughness, a powder of a transition metal T or T' being the major component in the powder of the hard boride phase, in the form of pure metal, alloy and/or compound, and a powder of a metal X chosen among aluminum and the metals of groups IIA and IIIB of the period table, in the form of element, alloy and/or compound, it being understood that the transition metal T or T' and the metal X can be introduced in the form of a powder of an alloy or a combination of these two elements; (b) granulating the mixture obtained from step (a); (c) compacting the granules obtained from step (b); and (d) sintering and/or the sintering under moderate gaseous pressure (sinter-HIP) and/or hot isostatic pressing (HIP) the compacted product obtained from step (c).

The transition metal T or T' (added according to the invention) can be added as element, that is not combined when mixing the other powders. However, in order to facilitate its introduction in such mixture, one may advantageously uses it in the form of its hydride of type THz, z being a whole or decimal number, or in the form of one of its alloys of type (T, L), L being one of the binder metals used according to the invention, i.e., Fe, Ni, Co or Cr, or as one of its mixed hydrides of type (T, L)Hz, z being a whole or decimal number, since these compounds or alloys generally are more easily milled than the pure metal.

The metal X can also be added in elementary form (i.e., not combined) when mixing the other powders. However, in order to facilitate its introduction in the mixture, one may advantageously use it in the form of an alloy XaLb or XcTd, and/or as the corresponding mixed hydride (X,L)Hz or (X,T)Hz', and/or a mixed boride Xa,Lb,Bt (L preferably being Fe, Ni or Co) since these alloys, hydrides or borides generally are more easily milled and are less reactive in contact with the environment than the pure metal X. In these alloys or compounds of the metal X, a, b, c, d, t, z and z' are whole or decimal numbers.

One may also advantageously utilize its milled hydride XHz, in which z is a whole or decimal number.

The mixture treated according to the invention for making the cermets preferably contains: 50 to 97 weight% of boride powder, 3 to 50 weight% of pure binder metal L, or of a prealloy in which L is the major component, 0 to 25 weight% of a powder of at least one metallic element L' which when alloyed with L, does not substantially decrease toughness, 0.1 to 20 weight% of a powder of metal X or one of its alloys or compounds, and 1 to 15 weight% of a powder of metal T or T' or one of its alloys and/or compounds.

The mixing with milling can be carried out according to any processing technique known for that purpose. It is preferably done by attrition in a ball mill.

Milling time is preferably between 2 and 48 hours.

Compaction is advantageously made under a pressure of 50 to 300 MPa.

Sintering is advantageously carried out at a temperature between 1300° and 1700 ° C., for one to three hours under a pressure of 1 to $10^4$ Pa of argon, or under a pressure of $10^5$ Pa of hydrogen, or under a vacuum of $10^{-2}$ to 10 Pa, or by hot isostatic pressing under 100–200 MPa of argon (HIP press: ASEA, QIH-6 for instance). One can also, in the same furnace, in one operation (sinter-HIP), utilize sintering followed by hot isostatic pressing under moderate pressure (for instance 5–10 MPa of argon).

Considering their remarkable properties, especially their toughness, the cermets made according the invention can be used for making metal cutting and rock drilling tools as well as wear parts.

The invention and its advantages are explained in more detail in the following examples, which in no way imply any restrictions on its use.

EXAMPLE 1 (COMPARATIVE):

The following mixture was made:

139.2 g of powder of titanium diboride ) specific surface BET: 1.5 m2/g; average grain diameter FISCHER: 4.3 μm); and 60.8 g of powder of carbonyl iron (average grain diameter FISCHER: 4.3 μm).

The mixture was treated as follows:

200 g of the mixture, 10 g of paraffine and 1750 g of steel balls (diameter 4 mm) were milled for 4 hours in the presence of 200 ml acetone. The homogenised mixture, milled and dried, was uniaxially compacted by die pressing into parallelepipedic specimens ISO B (ISO 3327), under a pressure of 200 MPa. After delubrication, the specimen was sintered at 1450° C., under a pressure of $10^3$ Pa argon for 1 hour. The open porosity, measured on the sintered specimens was 20%. It could be reduced to 12% by sintering for one hour at 1520° C.

The metallographic and X-ray diffraction studies show that the binder consisted essentially of the iron borides $Fe_2B$ and FeB.

Example 1 being considered as typical of prior art, in order to demonstrate the improvement due to the invention, the inventors conducted Example 2 which follows.

EXAMPLE 2

The following mixture was made:

136.0 g of powder of titanium diboride (specific surface BET: 0.52 $m^2/g$, average grain diameter FISCHER: 4.6 μm);

51.5 g of powder of carbonyl iron (average grain diameter FISCHER: 2.0 μm)

10.3 g of powder of the alloy $NdNi_5$; and 2.2 g of powder of the alloy $TiFe_2$.

Milling was carried out as in Example 1, with the only difference being that milling time was reduced to 2 hours. The compaction and delubrication were done as in Example 1.

Sintering was carried out at 1500° C., under a pressure of $10^3$ Pa of argon for one hour. The total porosity measured of the specimens was 2%.

Metallographic and X-ray diffraction studies show that the binder mainly consisted of an iron-nickel alloy. The presence of a fine dispersion of particles of neodymium oxide was observed, as well as of particles of titanium oxicarbonitride Ti(O,C,N).

The VICKERS hardness of the specimens under a load of 30 kg (294N) was HV30=14000±500 MPa.

EXAMPLE 3:

A series of cermets was made. The composition of the starting mixtures are given Table 1 which follows.

TABLE 1

| Ref. products | Composition wt. % $TiB_2$ (1 μm) | wt. % Fe (4 μm) | wt. % Ni (4 μm) | wt. % Mo (3 μm) | wt. % W (1 μm) | wt. % $TiAl_3$ (30 μm) | wt. % $TiAl_3$ (20 μm) | Theoretical density ($g/cm^3$) |
|---|---|---|---|---|---|---|---|---|
| FN* | 71.6 | 19.8 | 8.6 | — | — | — | — | 5.156 |
| FN Mo* | 71.6 | 17.0 | 7.4 | 4 | — | — | — | 5.255 |
| FN W* | 67.4 | 8.14 | 16.3 | — | 8.14 | — | — | 5.474 |
| FN + $TiAl_3$ 1 | 71.6 | 14.3 | 6.1 | — | — | 8 | — | 4.813 |
| FN + $TiAl_3$ 2 | 71.6 | 14.3 | 6.1 | — | — | — | 8 | 4.813 |
| FN + $TiAl_3$ 3 | 71.6 | 14.3 | 6.1 | — | — | 8 | — | 4.813 |
| FN + $TiAl_3$ + Mo | 71.6 | 13.6 | 5.8 | 1 | — | 8 | — | 4.837 |
| FN + $TiAl_3$ + W | 71.6 | 13.6 | 5.8 | — | 1 | 8 | — | 4.838 |

*typical of prior art cermets

* typical of prior art cermets

For each product a mixture of powders (of a total weight of 50 g) was made by milling in a ball mill operating as follows:

500 $cm^3$ container made of polyethylene austentic stainless steel balls (100 $cm^3$ with diameters 5 mm (30 $cm^3$) and 20 mm (70 $cm^3$);

rotation speed:. 45 turns/min; and milling time: 48 hours.

The milled mixture was separated from the balls by sieving.

The compaction of the specimens (5 g per specimen) was made under a pressure of 70 MPa, the die (of hard steel) being lubricated with zinc stearate.

The specimens are encapsulated and sintered by hot isostatic compression (press HIP ASEA Q1H-6) according to the following cycle:

| TEMPERATURE °C. Beginning | End | Speed °C./min. | PRESSURE (Argon MPa) Beginning | End | Speed MPa/min. | Time min. |
|---|---|---|---|---|---|---|
| 20 | 430 | 10 | vacuum* | vacuum* | — | 43 |
| 450 | 450 | — | vacuum* | vacuum* | — | 30 |
| 450 | 820 | 10 | vacuum* | vacuum* | — | 37 |
| 820 | 820 | — | vacuum* | 0.5 | — | 0.017 |
| 820 | 1000 | 10 | 0.5 | 0.5 | — | 18 |
| 1000 | 1350 | 8.75 | 0.5 | 150 | 3.75 | 40 |
| 1350 | 1350 | — | 150 | 150 | — | 30 |
| 1350 | 300 | 35 | 150 | 70 | 2,7 | 30 |
| 300 | 270 | 15 | 70 | 1 | 35 | 2 |

*vacuum: 1 Pa

The characteristics of the densified specimens are given in table 11.

TABLE II

| Ref. product | Properties Relative density (%) | HV 10* (MPa) | KIC** (MPa√m) |
|---|---|---|---|
| FN | 99.2 | 16900 ± 500 | 5.3 |
| FN Mo | 94.0 | 14900 ± 800 | 4.9 |
| FN W | 99.2 | 16600 ± 500 | 5.2 |
| FN + $TiAl_3$ 1 | 100.6 | 18000 ± 300 | 8.1 |
| FN + $TiAl_3$ 2 | 99.6 | 17400 ± 300 | 8.3 |
| FN + $TiAl_3$ 3 | 100.2 | 16900 ± 500 | 8.5 |
| FN + $TiAl_3$ + Mo | 100.0 | 17900 ± 200 | 8.1 |
| FN + $TiAl_3$ + W | 100.1 | 18000 ± 300 | 10.7 |

HV 10*: VICKERS hardness under a load of 10 kg (98N)

KIC**: critical stress intensity factor determined by indentation (PALMQVIST's method)

In the cermets according to the invention, it was observed that the theoretical density was practically achieved and the metallographic and X-ray diffraction studies showed that the binder mainly consisted of iron: the boride phases $Fe_2B$ or FeB did not appear, whereas these phases were present in the alloys FN, FNMo and FNW made according the prior art. This absence of iron boride, in the alloys made according to the invention was confirmed by an increase in toughness of the binder phase, quantified by the measurement of the critical stress intensity factor KIC with the PALMQVIST indentation method. Metallographic observations showed the presence of a fine dispersion of alumina ($Al_2O_3$) particles in the alloy according to the invention.

EXAMPLE 4

A series of cermets were made. The compositions of the starting mixtures are given in table III as follows.

TABLE III

| Ref. product | Composition wt. % TiB2 (6 μm) | wt. % Fe (4 μm) | wt. % Ni (4 μm) | wt. % Cr (8 μm) | wt. % $TiAl_3$ (30 μm) | wt. % 316 L* |
|---|---|---|---|---|---|---|
| $FNCr_1$ + $TiAl_3$ | 71.8 | 15.6 | 2.0 | 2.6 | 8.0 | — |
| $FNCr_2$ + $TiAl_3$ | 71.8 | 16.2 | 8.4 | 3.5 | 8.0 | — |
| SS | 72 | — | — | — | — | 28 |
| SS + $TiAl_3$ | 72 | — | — | — | 8 | 20 |

*Prealloyed stainless steel powder (grade 316 L)

For each composition the powder mixture is made .in a ball mill (stainless steel) as described in example 3.

The powder mixture was separated from the balls by sieving.

The compaction is made under 100 MPa in a die of hard steel lubricated by zinc stearate.

The specimens were encapsulated and sintered by hot isostatic compression (press HIP ASEA Q1H-6), according to the cycle described in Example 3.

The properties measured on completely densified specimens are given in the following table:

| Ref. product | Properties HV 10 (MPa) | KIC (MPa√m) | σ f (MPa) | E (GPa) |
|---|---|---|---|---|
| $FNCr_1$ + $TiAl_3$ | 14900 ± 900 | 6.4 ± 0.5 | 1093 ± 53 | 393 ± 27 |
| $FNCr_2$ + $TiAl_3$ | 17200 ± 800 | 6.1 ± 0.3 | nd | nd |
| SS | 17700 ± 600 | 5.4 ± 0.5 | nd | nd |

-continued

| Ref. product | Properties | | | |
|---|---|---|---|---|
| | HV 10 (MPa) | KIC (MPa√m) | σ f (MPa) | E (GPa) |
| SS + $TiAl_3$ | 17100 ± 700 | 7.7 ± 0.4 | 601 ± 27 | 317 ± 32 |

HV 10 : VICKERS hardness at a load of 10 kg (98 N)
KIC: critical stress intensity factor determined by indentation (PALMQVISTs method)
σ f: transverse rupture strength (4 points)
E: modulus of elasticity
nd: not determined Metallographic observation of the alloys according to the invention, with addition of $TiAl_3$, showed, in addition to me hard phase $TiB_2$ and the binder Fe/-Ni/Cr or stainless steel type 316, the presence of a fine dispersion of particles of alumina and titanium oxicarbonitride. The influence of the addition of $TiAl_3$ in the alloys with the stainless steel 316L as binder was observed: the hardness decreased only 3 % whereas the toughness increased about 40%.

EXAMPLE 5;

The following mixture was made 129.2 g of powder of titanium diboride (specific surface BET: 0.52 m2/g; average grain diameter FISCHER: 4.6 μm);

6.8 g of powder of chromium diboride (average grain diameter FISCHER: 4 μm);

51.5 g of powder of carbonyl iron (average grain diameter FISCHER: 2.0 μm);

10.3 g of powder of the alloy $NdNi_5$; and 2.2 g of powder of the alloy $TiFe_2$.

The milling was made as in Example 2. The compaction and delubrication were made as in Example 1. The sintering was made at 1600° C. under a pressure of argon of $10^3$ Pa for 2 hours. The total porosity measured on the sintered specimens was less than 0.5%.

Metallographic and X-ray studies show that the hard phase consisted of the solid solution $(Ti,Cr)B_2$, and that the binder mainly consisted of a Fe/Ni alloy. The presence of a fine dispersion of particles of neodymium oxide ($Nd_2O_3$) and titanium oxicarbonitride was noted.

The Vickers hardness under a load of 30 kg (294N) of the sintered specimens was 14900±500 MPa, i.e., 6% higher than that of the specimens of Example 2 (without substitution of $CrB_2$ for $TiB_2$) which was 14000±500 MPa.

What is claimed is:

1. A cermet comprising (i) as a major constituent, a hard phase of a simple boride TxBy, a mixture of simple borides TxBy +T'x'By' or a mixed boride (T,T')xBy, wherein T and T' are transition metals selected from the group consisting of Ti, Zr, Hf, V, Nb, Ta, Cr, Mo and W, and wherein x, x', y and y', may be the same or different and are whole or decimal numbers; (ii) a binder phase of a pure binder metal L, or an alloy with at least two metals L and L' wherein L is a metal chosen from the group consisting of Fe, Ni, Co and Cr and L' is at least one metallic element which, is effective for alloying with L, and when alloyed with L, does not substantially decrease toughness; (iii) a dispersion of particles of an oxicarbonitride of the transition metals T or T' which is the major metallic element in hard phase (i); and (iv) a dispersion of particles of an oxide of metal X chosen from the group consisting of aluminum, the alkaline earth metals, Sc, Y, the lanthanides, the actinides, and alloys formed by iron and the lanthanide metals, with the proviso that the oxicarbonitride forming the dispersion (iii) and the oxide forming dispersion (iv) can be combined as a complex oxide.

2. A cermet according to claim 1, wherein the ratios of x/y and x'/y' are identical or different, and are equal to about ½ or about 2/5.

3. A cermet according to claim 1, wherein metal X is Mg or Ca.

4. A cermet according to claim 2, wherein meal X is Mg or Ca.

5. A cermet according to claim 1, wherein metal X is selected from the group Ce, Pr, Nd, Gd, Dy, Th, U, and alloys formed by iron and the lanthanide metals.

6. A cermet according to claim 2, wherein metal X is selected from the group Ce, Pr, Nd, Gd, Dy, Th, U, and alloys formed by iron and the lanthanide metals.

7. A cermet according to claim 1, comprising from 20 to 99% by weight hard phase (i).

8. A cermet according to claim 7, comprising from 50 to 97% by weight hard phase (i).

9. A process for preparing a cermet according to claim 14, comprising (a) mixing through milling a hard phase powder containing simple boride TxBy or a mixture of simple borides TxBy+T'x'By' or mixed boride (T,T')xBy, a powder of pure binder metal L and/or a prealloy primarily of L, or a powder of pure binder metal L and/or a prealloy primarily of L and a material effective to form an alloy binder phase of at least two metals L and L' wherein L' is effective to alloy with L, and which when alloyed with L causes no substantial decrease in toughness, a powder of transition metal T or T' in the form of pure metal, alloy, and/or compound, and a powder of metal X as an elemental metal, alloy and/or compound with the proviso that the transition metal T or T' and the metal X can be introduced in the form of a powder of an alloy or as a combination of the two elements;

(b) granulating the mixture obtained from step (a);

(c) compacting granules obtained from step (b); and (d) sintering or sintering and hot isostatic pressing or sintering under moderate gaseous pressure or hot isostatic pressing under moderate pressure, of the compacted product obtained from step (c).

10. A process according to claim 9, wherein the transition metal T or T' added in the form of a powder, is in the form of a hydride of type THz, z being a whole or decimal number, or in the form of an alloy of the type (T,L), L being Fe, Ni, Co or Cr, or in the form of a mixed hydride of type (T,L)Hz, z being a whole or decimal number.

11. A process according to claim 9, wherein metal X is added in the form of an alloy XaLb or XcTd, and/or of a corresponding mixed hydride (X,L)Hz or (X,T)Hz', and/or a mixed boride XaLbBt wherein L is Fe, Ni or Co, and/or of a hydride XHz, wherein a, b, c, d, t, z and z' are whole or decimal numbers.

12. A process according to claim 9, wherein the mixture of step (a) comprises 50 to 97% by weight boride powder, 3 to 50% by weight binder metal powder L, and/or a prealloy comprising primarily L, up to 25% by weight of element L' or a prealloy thereof, 0.1 to 20% by weight powder of metal X or an alloy or compound thereof, and 1 to 15% by weight powder of metal T or T' or an alloy and/or compound thereof.

13. A process according to claim 9, comprising milling for 2 to 48 hours.

14. A process according to claim 9, comprising compacting under a pressure of 50 to 300 MPa.

15. A process according to claim 9, comprising sintering at from 1300° to 1700° C. for 1 to 3 hours, under pressure of 1 to 104 Pa of argon or under pressure of about $10^5$ Pa of hydrogen, or under vacuum of $10^{-2}$ to 10 Pa, or by hot isostatic pressing under 100 to 200 MPa argon, or by sintering followed by hot isostatic compression under moderate pressure in the same furnace in one single operation.

16. A metal cutting, rock drilling or mineral tool of the cermet of claim 1.

17. A wear part of the cermet of claim 1.

* * * * *